United States Patent [19]

Murate et al.

[11] Patent Number: 4,689,921

[45] Date of Patent: Sep. 1, 1987

[54] PROCESS OF CONTOURING THE EDGES OF A CERAMIC ROTOR

[75] Inventors: Shigenori Murate; Yoshinori Hattori, both of Aichi, Japan

[73] Assignee: NGK Spark Plug Co., Ltd., Aichi, Japan

[21] Appl. No.: 796,714

[22] Filed: Nov. 12, 1985

[30] Foreign Application Priority Data

Nov. 13, 1984 [JP] Japan ..... 59-239184

[51] Int. Cl.[4] ..... B24B 1/00

[52] U.S. Cl. ..... 51/317; 51/7; 51/19

[58] Field of Search ..... 51/317, 316, 7, 17, 51/19, 281 R

[56] References Cited

U.S. PATENT DOCUMENTS

| | | | |
|---|---|---|---|
| 3,464,163 | 9/1969 | Ferrara | 51/19 |
| 3,623,278 | 11/1971 | Schwartz | 51/317 |
| 4,185,968 | 1/1980 | Scherbaum | 51/316 |

*Primary Examiner*—Robert P. Olszewski
*Assistant Examiner*—Maurina Rachuba
*Attorney, Agent, or Firm*—Finnegan, Henderson Farabow, Garrett and Dunner

[57] ABSTRACT

A method of improving the impact resistance of a ceramic turbine rotor by rotating the rotor in a number of abrasive grindstones such that the edges of the rotor are rounded to a radius in the range of about 0.2 to 1 mm.

11 Claims, 2 Drawing Figures

PROCESS OF CONTOURING THE EDGES OF A CERAMIC ROTOR

BACKGROUND OF THE INVENTION

This invention relates to a process used in the manufacture of ceramic rotors for turbines.

Attempts have heretofore been made to use ceramics in a compressor rotor for a gas turbine, power turbine rotor, turbocharger rotor and the like for improving its thermal resistance. These rotors have been subjected to grinding in which a diamond grindstone is applied to edges of blade end faces to provide the latter with a rounded and beveled shape (the so-called "R" and "C") to increase the resistance of the blade to chipping or damage by impact with particles suspended in the gas passing through the turbine as the rotor is rotated at high speed.

The aforementioned conventional grinding techniques tend to crack the edges of the rotor, thereby lowering the impact resistance of the rotor to foreign articles that may impinge on the rotor. Further, such processes induce large variation of "R" and "C" tolerance values and increase variation of the product.

SUMMARY OF THE INVENTION

The present invention solves the aforementioned problems by providing a method for shaping the edges of a sintered ceramic turbine motor. The method includes the steps of first providing a plurality of grindstones having a diameter in the range of about 1–10 millimeters. The rotor is placed in the grindstones and rotated within the grindstones until the radius of the edges of the rotor is in the range of about 0.2 to 1 millimeter. In a preferred embodiment of the method, the rotor is rotated within the grindstones in the presence of a liquid. It is further preferred that the rotor be rotated within the grindstones about the axis of rotation of the rotor. It is also preferred that the rotor is rotated in a first direction about the axis of rotation and in a subsequent step is rotated in the opposite direction from the first direction, again about the axis of rotation of the rotor.

The invention will now be described in terms of preferred embodiments with the aid of the figures which form a part of the present specification.

BRIEF DESCRIPTION OF THE DRAWINGS

Reference will now be made to the accompanying drawings in which.

DESCRIPTION OF THE PREFERRED EMBODIMENTS

A preferred manner of carrying out the present invention will now be disclosed.

In accordance with the invention there is provided a method of shaping the edges of a sintered ceramic turbine rotor. As here embodied and depicted in FIG. 1, the turbine rotor is disposed vertically in a container 3 containing a plurality of grindstones 2. The turbine rotor depicted is of a representative shape having an axis of rotation that is vertical in FIG. 1. That axis of rotation conforms to the axis of rotation of the rotor when it is used in a turbine. As here embodied, the rotor 1 includes a plurality of blades or vanes 11. As noted previously, it is a primary object of the present invention to provide a radius at the tips of such vanes to increase the impact resistance of such vanes during the operation of such a rotor at high speed and at high temperatures. The vanes of the rotor are shaped by first providing a plurality of grindstones having a diameter in the range of about 1 to 10 millimeters. The grindstones are comprised of an abrasive material and preferably are comprised of or consist essentially of sintered alumina, silicon carbide, or silicon nitride.

Figure 1:
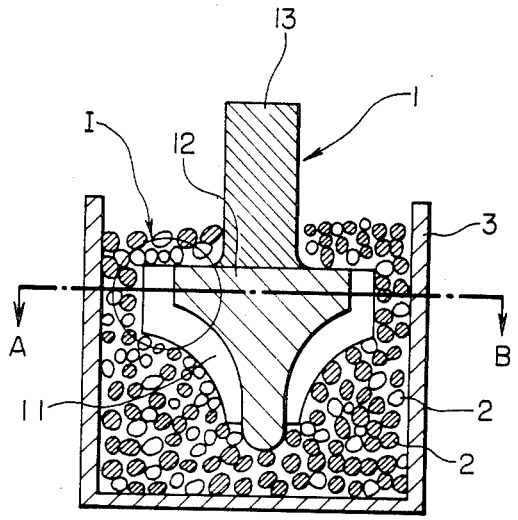
FIG. 1 is a cross-sectional view showing the manner in which a ceramic rotor is treated in accordance with the present invention.

In accordance with the invention, the rotor is placed within the grindstones as exemplified by the drawing of FIG. 1 and the rotor is then rotated within those grindstones. The grindstones may be utilized in a dry condition or the grindstones may be wet with such liquids as water or alcohol which are nonreactive with the materials of the system, i.e., the grindstones, the container, and the rotor. The presence of the liquid facilitates the fluidity of the grindstones, thereby facilitating the rotation of the rotor within the grindstones. Preferably the volume of liquid used in this embodiment of the invention would be less than 3 times the volume of the interstices between the grindstones.

Figure 2:
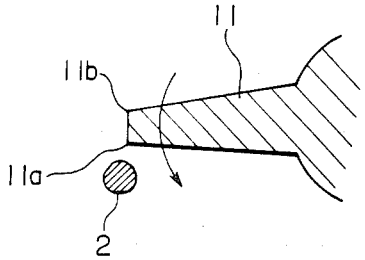
FIG. 2 is a partial cross section taken along the line A-B of a portion of FIG. 1.

The rotor is rotated within the grindstones for a time sufficient for the grindstones to abrade the edges of the vanes comprising the portion of the rotor to a radius in the range of about 0.2 to 1 millimeter. As depicted in FIG. 2, rotation of the rotor in the direction of the arrow will result in the grindstones, here exemplified as a single grindstone 2, striking the leading corner 11*a* of the vane 11 in such a manner that the abrasive grindstones provide the desired radius on the tip of the rotor vane. After a period of rotation in one direction it is preferred that the direction of rotation be reversed and the rotor rotated again about its axis at rotation in the opposite direction such that the corners of the vanes, e.g., the corner 11*b* of the vane 11 in FIG. 2, will also be abraded to the proper radius. This operation may be repeated until the radius of each edge is within the desired range. It is not necessary that the radii of the leading and trailing edges of the vane be identical. Therefore the amount of time the rotor is rotated within the grindstones in one direction need not be equal for the opposite direction.

The present invention has utilized in a number of comparative examples. Seven ceramic rotors formed of sintered silicon nitride were rotated at 50 rpm in a plurality of silicon carbide grindstones having diameters as shown in the following table. The rotors were rotated within the grindstones for a period of time set out in the table to make the edge of the vane round with a uniform radius also set out in the table. After rotating in the grindstones, the rotors were rotated for ten minutes with the peripheral edge reaching a circumferencial speed of 500 meters per second within an engine exhausting at a temperature of 900° C. to assess the susceptibility of the various rotors to chipping. The following table sets out the results of such comparisons. The examples set out as 1 and 2 were carried out using processes which were outside the scope of the present invention. Examples 1 and 2 are then compared to the process of the present invention set out as examples 3 through 7.

TABLE

| Example No. | Diameter of Grindstones (mm) | Time Required for Rotation (hrs) | Radius of Rounding (mm) | Presence or Absence of Chipping | Remarks |
|---|---|---|---|---|---|
| 1 | 0.5 | 3 | 0.1 | Absent | Not present Invention |
| 2 | 15.0 | 3 | 0.5 | Present | Not present Invention |
| 3 | 1.0 | 3 | 0.2 | Absent | Present Invention |
| 4 | 3.0 | 3 | 0.3 | " | Present Invention |
| 5 | 6.0 | 3 | 0.6 | " | Present Invention |
| 6 | 6.0 | 10 | 1.0 | " | Present Invention |
| 7 | 10.0 | 3 | 0.8 | " | Present Invention |

For purposes of the comparison, a conventional file (Japanese Institute of Standards #200) instead of grindstones was used to obtain the same configuration on the edge of the vanes of the ceramic rotor as was obtained by the present invention. Both the conventional file and the invention were used to obtain a vane radius of about 0.3 millimeters. After forming the edges of the vanes in such a manner, the rotors were tested to determine if there was a difference in the amount of chipping even though the radius of curvature of the rotor vanes was the same.

The testing revealed that the rotors having the vane edges formed to a radius of 0.3 millimeters with a file were prone to chipping, while the rotors having a similar radius formed by the present invention showed excellent resistance to impact from foreign material and were not as susceptible to chipping. Thus, the rotor vanes having radii formed by the method of the present invention provides advantages whereupon the vane edges exhibit significantly greater impact resistance with respect to colliding with particles ingested by the turbine during operation.

While the present invention has been disclosed in terms of preferred embodiments, the invention is not limited thereto. Various additions and modifications may be made by those skilled in the art not departing from the essential features of the present invention, which is intended to be defined and secured by the appended claims.

What is claimed is:

1. A method of shaping the edges of a sintered ceramic turbine rotor, said method comprising the steps of:

providing a plurality of grindstones having a diameter in the range of from about 1 to 10 mm;

placing said rotor in said grindstones; and rotating said rotor within said grindstones such that the radius of the edges of said rotor is in the range of about 0.2 to 1 mm.

2. The method of claim 1, wherein the step of rotating said rotor within said grindstones is carried out in the presence of a liquid.

3. The method of claim 2, wherein said liquid is present in an amount less than about three times the volume of the interstices between said grindstones.

4. The method of claim 1, wherein the step of rotating said rotor within said grindstones is carried out with said grindstones being dry.

5. The method of claim 1, wherein said rotor is rotated about the axis of rotation of said rotor.

6. The method of claim 5, wherein said rotating step includes a first step of rotating said rotor within said grindstones in a first direction about the axis of rotation of said rotor and a subsequent step of rotating said rotor within said grindstones in the opposite direction from said first direction about said axis of rotation.

7. The method of claim 1, wherein said grindstones are comprised of a sintered ceramic material selected from the group consisting of alumina, silicon carbide, and silicon nitride.

8. A method of increasing the impact resistance of the vanes of a sintered ceramic turbine rotor, said method comprising the steps of:

placing said rotor in a plurality of generally spherical abrasive grindstones having a diameter in the range of about 1 to 10 mm; and rotating said rotor about its axis of rotation in said grindstones for a period of time such that the edges of said vanes are abraded by said grindstones to a radius in the range of 0.2 to 1 mm.

9. The method of claim 8 wherein said rotating step includes the step of rotating said rotor in a first direction about its axis of rotation and a separate step of rotating said rotor about its axis of rotation in a direction opposite said first direction.

10. The method of claim 8 wherein said grindstones are comprised of a sintered ceramic material selected from the group consisting of alumina, silicon carbide and silicon nitride.

11. The method of claim 10, wherein said rotor consists essentially of silicon nitride.

* * * * *